US008523327B2

(12) United States Patent
Vaeth et al.

(10) Patent No.: US 8,523,327 B2
(45) **Date of Patent: *Sep. 3, 2013**

(54) PRINTHEAD INCLUDING PORT AFTER FILTER

(75) Inventors: Kathleen M. Vaeth, Penfield, NY (US); John C. Brazas, Hilton, NY (US); David L. Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 325 days.

This patent is subject to a terminal disclaimer.

(21) Appl. No.: 12/712,248

(22) Filed: Feb. 25, 2010

(65) Prior Publication Data

US 2011/0205319 A1 Aug. 25, 2011

(51) Int. Cl.
*B41J 2/04* (2006.01)
*B41J 2/05* (2006.01)

(52) U.S. Cl.
USPC ..... 347/54; 347/66; 347/93

(58) Field of Classification Search
USPC ..... 347/20, 54, 65, 66, 85, 86, 92, 93
See application file for complete search history.

(56) References Cited

U.S. PATENT DOCUMENTS

| | | | | |
|---|---|---|---|---|
| 4,068,241 | A | 1/1978 | Yamada | |
| 4,636,808 | A | 1/1987 | Herron | |
| 4,638,327 | A | 1/1987 | Sutera et al. | |
| 4,639,748 | A | 1/1987 | Drake et al. | |
| 5,124,717 | A | 6/1992 | Campanelli et al. | |
| 5,141,596 | A | 8/1992 | Hawkins et al. | |
| 5,154,815 | A * | 10/1992 | O'Neill | 205/75 |
| 5,204,690 | A | 4/1993 | Lorenze, Jr. et al. | |
| 5,489,930 | A | 2/1996 | Anderson | |
| 5,691,753 | A | 11/1997 | Hilton | |
| 6,079,821 | A | 6/2000 | Chwalek et al. | |
| 6,190,009 | B1 * | 2/2001 | Kitahara | 347/93 |
| 6,213,590 | B1 | 4/2001 | Fujii et al. | |
| 6,234,623 | B1 | 5/2001 | Drake | |
| 6,264,309 | B1 | 7/2001 | Sullivan | |
| 6,267,251 | B1 | 7/2001 | Sullivan | |
| 6,270,212 | B1 * | 8/2001 | Kusumi et al. | 347/93 |
| 6,280,643 | B1 | 8/2001 | Silverbrook | |
| 6,428,156 | B1 * | 8/2002 | Waller et al. | 347/89 |
| 6,457,807 | B1 | 10/2002 | Hawkins et al. | |
| 6,491,362 | B1 | 12/2002 | Jeanmaire | |
| 6,505,921 | B2 | 1/2003 | Chwalek et al. | |
| 6,554,410 | B2 | 4/2003 | Jeanmaire et al. | |
| 6,575,566 | B1 | 6/2003 | Jeanmaire et al. | |
| 6,582,064 | B2 | 6/2003 | Cruz-Uribe et al. | |
| 6,583,350 | B1 | 6/2003 | Gee et al. | |
| 6,588,888 | B2 | 7/2003 | Jeanmaire et al. | |
| 6,626,522 | B2 | 9/2003 | Rapp et al. | |

(Continued)

FOREIGN PATENT DOCUMENTS

| | | |
|---|---|---|
| EP | 901 906 | 3/1999 |
| EP | 1 095 776 | 10/2006 |
| WO | WO 90/08038 A1 | 7/1990 |

*Primary Examiner* — Anh T. N. Vo
(74) *Attorney, Agent, or Firm* — William R. Zimmerli

(57) ABSTRACT

A printhead includes a liquid source, a first substrate, a filter, and a liquid chamber. Portions of the first substrate define a nozzle adapted to emit liquid from the liquid source. The liquid chamber includes a port. The liquid chamber is in fluid communication with the nozzle and the filter and is positioned between the first substrate and the filter.

16 Claims, 11 Drawing Sheets

(56) References Cited

U.S. PATENT DOCUMENTS

| | | | | |
|---|---|---|---|---|
| 6,793,328 | B2 | 9/2004 | Jeanmaire | |
| 6,827,429 | B2 | 12/2004 | Jeanmaire et al. | |
| 6,851,796 | B2 | 2/2005 | Jeanmaire et al. | |
| 6,905,619 | B2 | 6/2005 | Kawamura et al. | |
| 6,916,090 | B2 | 7/2005 | Valley et al. | |
| 6,923,530 | B2 | 8/2005 | Anderson et al. | |
| 6,932,462 | B2 * | 8/2005 | Watanabe | 347/65 |
| 6,943,037 | B2 | 9/2005 | Anagnostopoulos et al. | |
| 7,101,030 | B2 | 9/2006 | Clark et al. | |
| 7,458,666 | B2 * | 12/2008 | Momose | 347/85 |
| 7,484,835 | B2 * | 2/2009 | Kim et al. | 347/67 |
| 7,607,766 | B2 | 10/2009 | Steiner | |
| 7,862,158 | B2 * | 1/2011 | Fujii et al. | 347/63 |
| 2004/0012662 | A1 | 1/2004 | Kneezel et al. | |
| 2004/0179073 | A1 | 9/2004 | Valley et al. | |
| 2005/0018022 | A1 | 1/2005 | Studer et al. | |
| 2005/0151798 | A1 | 7/2005 | Merz et al. | |
| 2006/0055739 | A1 | 3/2006 | Kim et al. | |
| 2007/0064069 | A1 | 3/2007 | Murad et al. | |
| 2011/0205306 | A1 * | 8/2011 | Vaeth et al. | 347/68 |

* cited by examiner

PRINTHEAD INCLUDING PORT AFTER FILTER

CROSS REFERENCE TO RELATED APPLICATIONS

Reference is made to commonly-assigned, U.S. patent application Ser. No. 12/712,256, entitled "REINFORCED MEMBRANE FILTER FOR PRINTHEAD" and Ser. No. 12/712,261, entitled "METHOD OF MANUFACTURING FILTER FOR PRINTHEAD", both filed concurrently herewith.

FIELD OF THE INVENTION

This invention relates generally to the field of digitally controlled printing systems and, in particular, to the filtering of liquids that are subsequently emitted by a printhead of the printing system.

BACKGROUND OF THE INVENTION

The use of inkjet printers for printing information on recording media is well established. Printers employed for this purpose can include continuous printing systems which emit a continuous stream of drops from which specific drops are selected for printing in accordance with print data. Other printers can include drop-on-demand printing systems that selectively form and emit printing drops only when specifically required by print data information.

Continuous printer systems typically include a printhead that incorporates a liquid supply system and a nozzle plate having a plurality of nozzles fed by the liquid supply system. The liquid supply system provides the liquid to the nozzles with a pressure sufficient to jet an individual stream of the liquid from each of the nozzles. The fluid pressures required to form the liquid jets are typically much greater than the fluid pressures employed in drop-on-demand printer systems.

Different methods known in the art have been used to produce various components within a printer system. Some techniques that have been employed to form micro-electro-mechanical systems (MEMS) have also been employed to form various printhead components. MEMS processes typically include modified semiconductor device fabrication technologies. Various MEMS processes typically combine photo-imaging techniques with etching techniques to form various features in a substrate. The photo-imaging techniques are employed to define regions of a substrate that are to be preferentially etched from other regions of the substrate that should not to be etched. MEMS processes can be applied to single layer substrates or to substrates made up of multiple layers of materials having different material properties. MEMS processes have been employed to produce nozzle plates along with other printhead structures such as ink feed channels, ink reservoirs, electrical conductors, electrodes and various insulator and dielectric components.

Particulate contamination in a printing system can adversely affect quality and performance, especially in printing systems that include printheads with small diameter nozzles. Particulates present in the liquid can either cause a complete blockage or partial blockage in one or more nozzles. Some blockages reduce or even prevent liquid from being emitted from printhead nozzles while other blockages can cause a stream of liquid jetted from printhead nozzles to be randomly directed away from its desired trajectory. Regardless of the type of blockage, nozzle blockage is deleterious to high quality printing and can adversely affect printhead reliability. This becomes even more important when using a page wide printing system that accomplishes printing in a single pass. During a single pass printing operation, usually all of the printing nozzles of a printhead are operational in order to achieve a desired image quality. As the printing system has only one opportunity to print a given section of media, image artifacts can result when one or more nozzles are blocked or otherwise not working properly.

Conventional printheads have included one or more filters positioned at various locations in the fluid path to reduce problems associated with particulate contamination. Even so, there is an ongoing need to reduce particulate contamination in printheads and printing systems and an ongoing need for printhead filters that provide adequate filtration with acceptable levels of pressure loss across the filter. There is also an ongoing need for effective and practical methods for forming printhead filters using MEMS fabrication techniques.

SUMMARY OF THE INVENTION

According to an aspect of the present invention, a printhead includes a liquid source, a first substrate, a filter, and a liquid chamber. Portions of the first substrate define a nozzle adapted to emit liquid from the liquid source. The liquid chamber includes a port. The liquid chamber is in fluid communication with the nozzle and the filter and is positioned between the first substrate and the filter.

BRIEF DESCRIPTION OF THE DRAWINGS

In the detailed description of the example embodiments of the invention presented below, reference is made to the accompanying drawings, in which.

DETAILED DESCRIPTION

Figure 1:
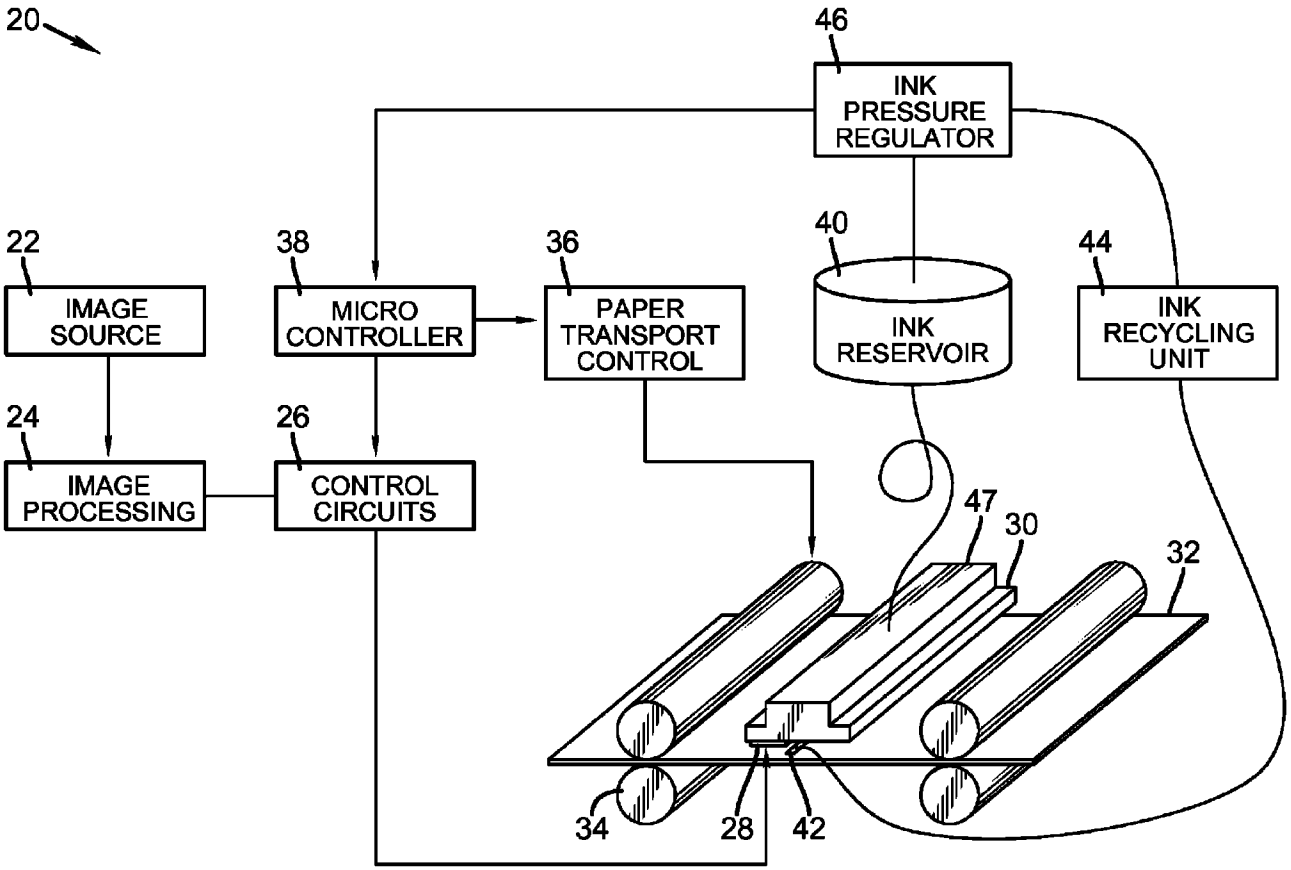
FIG. 1 is a simplified schematic block diagram of an example embodiment of a printing system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Figure 2:
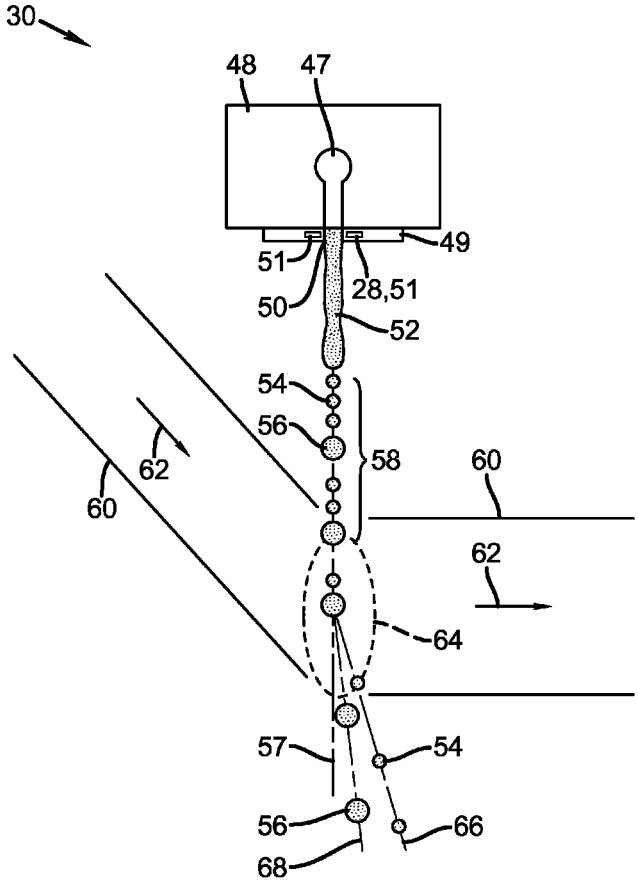
FIG. 2 is a schematic view of an example embodiment of a continuous printhead made in accordance with the present invention.
Figure 3:
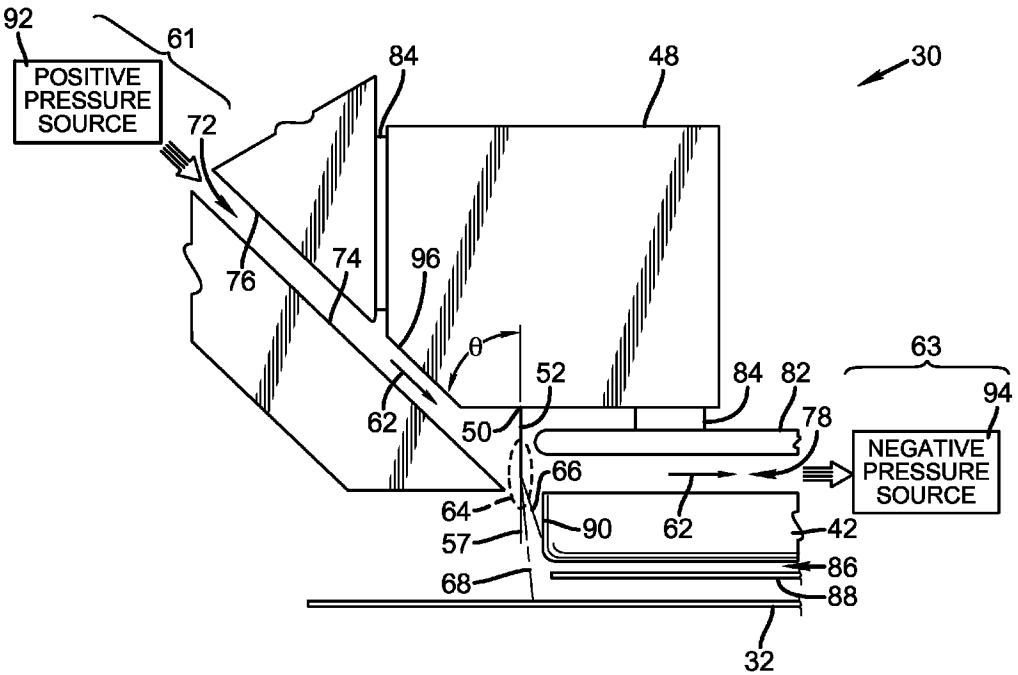
FIG. 3 is a schematic view of an example embodiment of a continuous printhead made in accordance with the present invention.

Referring to FIGS. 1 through 3, example embodiments of a printing system and a continuous printhead are shown that include the present invention described below. It is contemplated that the present invention also finds application in other types of printheads or jetting modules including, for example, drop on demand printheads and other types of continuous printheads.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and apply time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transfer system 34, which is electronically controlled by a recording medium transfer control system 36, and which in turn is controlled by a micro-controller 38. The recording medium transfer system shown in FIG. 1 is a schematic only, and many different mechanical configurations are possible. For example, a transfer roller could be used as recording medium transfer system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous inkjet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. In such an embodiment, the ink pressure regulator 46 can comprise an ink pump control system. As shown in FIG. 1, catcher 42 is a type of catcher commonly referred to as a "knife edge" catcher.

The ink is distributed to printhead 30 through an ink manifold 47 which is sometimes referred to as a channel. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism which is described in more detail below with reference to FIGS. 2 and 3.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be an integral portion of the jetting module 48.

Liquid, for example, ink, is emitted under pressure through each nozzle 50 of the array to form streams, commonly referred to as jets or filaments, of liquid 52. In FIG. 2, the array or plurality of nozzles extends into and out of the figure. Typically, the orifice size of nozzle 50 is from about 5 μm to about 25 μm.

Jetting module 48 is operable to form liquid drops having a first size or volume and liquid drops having a second size or volume through each nozzle. To accomplish this, jetting module 48 includes a drop stimulation or drop forming device 28, for example, a heater, a piezoelectric actuator, or an electrohydrodynamic stimulator that, when selectively activated, perturbs each jet of liquid 52, for example, ink, to induce portions of each jet to break-off from the jet and coalesce to form drops 54, 56.

In FIG. 2, drop forming device 28 is a heater 51, for example, an asymmetric heater or a ring heater (either segmented or not segmented), located in a nozzle plate 49 on one or both sides of nozzle 50. This type of drop formation is known with certain aspects having been described in, for example, one or more of U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes or volumes, for example, in the form of large drops 56 having a first size or volume, and small drops 54 having a second size or volume. The ratio of the mass of the large drops 56 to the mass of the small drops 54 is typically approximately an integer between 2 and 10. A drop stream 58 including drops 54, 56 follows a drop path or trajectory 57. Typically, drop sizes are from about 1 pL to about 20 pL.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the un-deflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIGS. 1 and 3).

When catcher 42 is positioned to intercept large drop trajectory 68, small drops 54 are deflected sufficiently to avoid contact with catcher 42 and strike recording medium 32. As the small drops are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47 (shown in FIG. 2), is emitted under pressure through each nozzle 50 of the array to form jets of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the jet of liquid 52 to induce portions of the jet to break off from the jet to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle θ of approximately 45° relative to the stream of liquid 52 toward drop deflection zone 64 (also shown in FIG. 2). Optional seal(s) 84 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. Optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded. Small drops 54 bypass catcher 42 and travel on to recording medium 32.

Alternatively, deflection can be accomplished by applying heat asymmetrically to a jet of liquid 52 using an asymmetric heater 51. When used in this capacity, asymmetric heater 51 typically operates as the drop forming mechanism in addition to the deflection mechanism. This type of drop formation and deflection is known having been described in, for example, U.S. Pat. No. 6,079,821, issued to Chwalek et al., on Jun. 27, 2000. Deflection can also be accomplished using an electrostatic deflection mechanism. Typically, the electrostatic deflection mechanism either incorporates drop charging and drop deflection in a single electrode, like the one described in U.S. Pat. No. 4,636,808, or includes separate drop charging and drop deflection electrodes.

As shown in FIG. 3, catcher 42 is a type of catcher commonly referred to as a "Coanda" catcher. However, the "knife edge" catcher shown in FIG. 1 and the "Coanda" catcher shown in FIG. 3 are interchangeable and either can be implemented. Alternatively, catcher 42 can be of any suitable design including, but not limited to, a porous face catcher, a delimited edge catcher, or combinations of any of those described above.

Figure 4A:
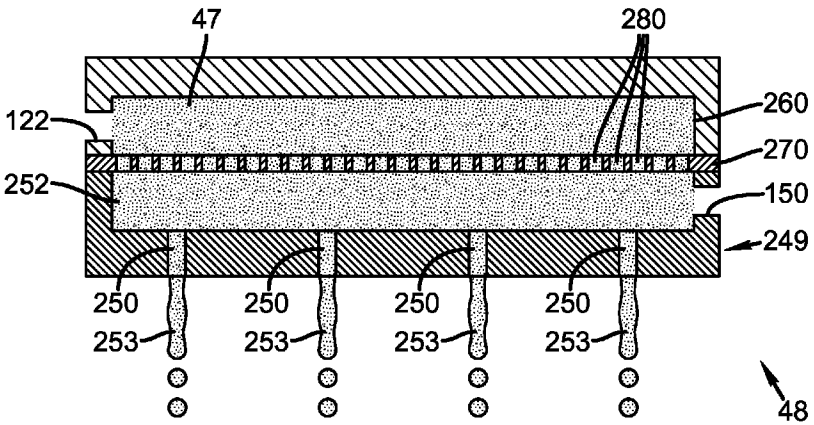
FIG. 4A is a schematic cross sectional view of a jetting module including an example embodiment of the present invention.

Referring to FIG. 4A, a cross-sectional view of jetting module 48 of printhead 30 including an example embodiment of the present invention is shown. Printhead 30 includes a source of liquid 260 in fluid communication with at least one nozzle 250 of jetting module 48. Portions of a first substrate 249, sometimes referred to as a nozzle plate, define nozzle(s) 250 which is adapted to emit liquid supplied from the source of liquid 260. Jetting module 48 includes a filter 270. A liquid chamber 252 is in fluid communication with each of the at least one nozzles 250 and filter 270. Liquid chamber 252 is located between the at least one nozzle 250 defined by corresponding portions of first substrate 249 and filter 270. Liquid chamber 252 includes a port 150. Port 150 is located downstream relative to filter 270.

As shown in FIG. 4A, the source of liquid 260 includes liquid manifold 47 although other configurations of liquid source 260 are permitted. Liquid manifold 47 is connected in fluid communication to liquid reservoir 40 (shown in FIG. 1) through a port 122 located in manifold 47. Port 122 is upstream relative to filter 270. Liquid is provided to nozzles 250 from manifold 47 under pressure sufficient to form liquid jets 253. Liquid manifold 47 is often referred to as a second liquid chamber with liquid chamber 252 being referred to as a first liquid chamber.

Typically, port 150 functions as an outlet port for liquid while port 122 functions as an inlet port. In alternative embodiments of the present invention, jetting module 48 can include more ports, described in more detail below. The functions of ports 150 and 122 as well as any additional ports can also change. This is also described in more detail below.

As shown in FIG. 4A, filter 270 is a separately formed printhead component and is assembled between substrate 249 and liquid supply manifold 47. Provided to filter various particulates (not shown) in the liquid, filter 270 is shared by nozzles 250 such that filtered liquid can be provided to any or all of the nozzles 250 from one or more portions of filter 270. Filter 270 includes a plurality of pores 280 adapted to filter the particulate matter from the liquid. Each pore 280 is appropriately sized and shaped to filter a desired size of particulate matter as the liquid flows through pores 280. For example, the cross sectional area of each pore 280, or diameter depending on the shape of each pore 280, is selected such that a desired size of particulate matter is effectively filtered from the liquid without creating an undesired level of pressure loss or pressure drop across the filter between the upstream and downstream sides of the filter. The number, size, shape and spacing of the pores 280 is also selected such that the structural robustness of filter 270 is sufficient for the operating environment contemplated. The height (or thickness) of filter 270 is also selected to provide structural robustness and to effectively filter from the liquid without creating an unacceptably large loss in pressure across the filter 270.

Filter 270 is a sieve type filter including pores that are through holes in a single layer of material. Such filters are preferred because it has been determined that particle filtering tolerances can be more easily maintained and adhered to when compared to filter pores 280 that include tortuous paths. Pores 280 can be columnar or pores 280 can include sloped or tapered walls, so that the pore entrance size differs from the pore exit size; the smaller of the pore entrance and pore exit size determining the size of particle blocked by the filter pore. Pores 280 can be oriented perpendicular the surface of the filter or the pores 280 can be angled, for example, relative to a surface of the filter. Filter 270 can include more than one material layer. Additionally, the overall size of filter 270, usually expressed in terms of height or thickness, can be smaller when compared to filter pores 280 that include tortuous paths. Filters including pores 280 with tortuous paths do provide sufficient filtering in some applications, for example, applications in which the size of particle to be filtered is large enough to be consistently trapped by such filters 270. Usually, pores 280 are arranged in a two dimensional pattern in which the pores 280 are positioned in either an ordered manner relative to each other or a random manner relative to each other. Pores 280 can also be grouped together with non-porous segments positioned between pore groups. Typically, pore 280 sizes are from 1 to 10 μm, and more preferably from 1 to 5 μm. While filter 270 is shown as a planar structure, corrugated or pleated filters can also be used. These filters can have increased filter capacity to trap more debris before becoming overloaded.

Pores 280 can include various sectional shapes suitable for filtering the liquid 52. For example, pores 110 can have triangular, square, oval, or rectangular cross sectional shapes. When pores 280 include corners, the corners should be rounded. Sharp corners are undesirable from a mechanical robustness standpoint. The size of pores 280 can vary in accordance with a measured or anticipated size of particulate manner within liquid 52. For example, when circular shaped pores 280 are used, diameters are on the order of 4 μm. When triangular shaped pores 280 are used, side dimensions are on the order of 5 μm. Pores 280 can also have a "honeycombed" or cellular composition with cell sizes on the order of 1 μm. Pores 280 can also have a uniform shape and vary in size. For example, pores 280 can be round in shape but individual pores 280 can have different diameters when compared to each other. However, as both the pressure drop for fluid passing through a pore and the particle removing capability of the filter 270 are related to pore size, it is preferable that each pore of the plurality of pores 280 has a substantially uniform size when compared to other pores of the plurality of pores 280 to provide effective filtering and predictable pressure drop across filter 270. Pores 280 are through holes arranged in a two dimensional pattern in which the pores 280 are positioned in an ordered manner relative to each other.

Filter 270 can be made from a stainless steel material, a ceramic material, a polymer material, including for example, track etched polymer membranes, or other metals such as electroformed metals, and etched metals. When filter 270 is electro-formed, suitable metals include, for example, Ni, Pd, and combinations thereof. When filter 270 includes a tortuous path, it is usually made from a woven mesh, a fibrous mat, a foam material, or another material that lends itself to providing a tortuous path.

Figure 4B:
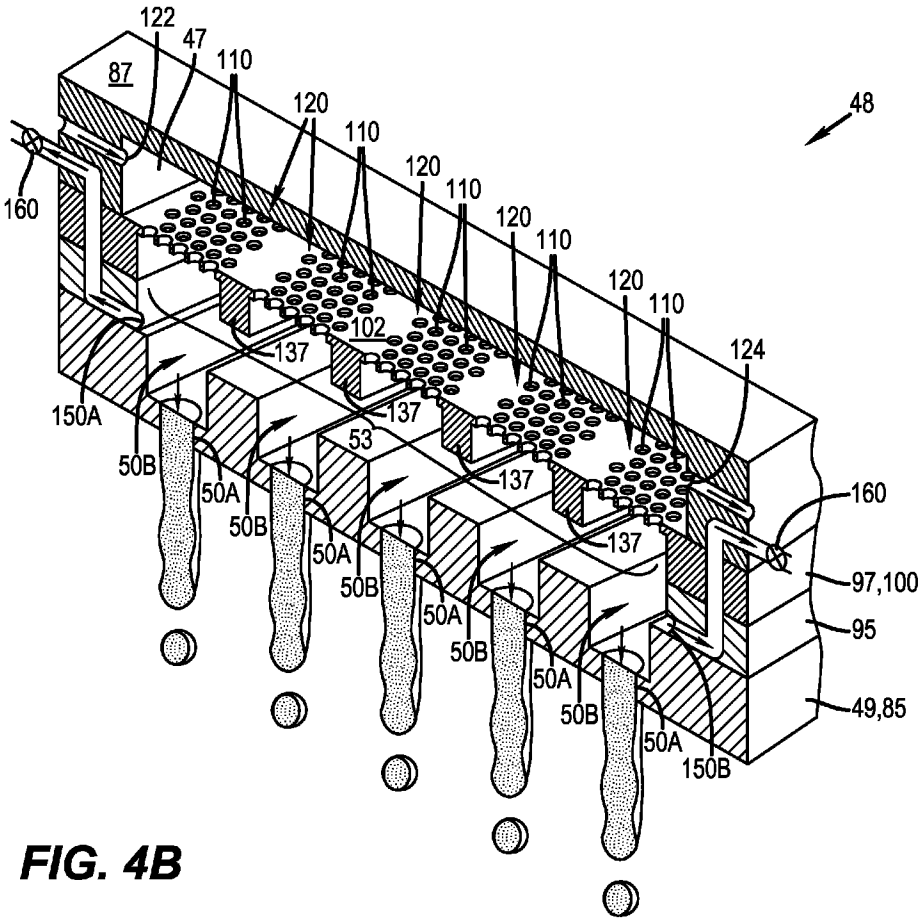
FIG. 4B is a schematic perspective view of a jetting module including another example embodiment of the present invention.

Referring to FIG. 4B, a cross-sectional view of jetting module 48 of printhead 30 including another example embodiment of the present invention is shown. Nozzle plate 49 is formed from a substrate 85 with portions of substrate 85 defining a plurality of nozzles 50. Manifold 47 is formed from a substrate 87. Jetting module 48 also includes a filter 100 adapted to filter particulate matter from liquid flowing through jetting module 48. Filter 100 is formed in a substrate 97. In this example embodiment of the present invention, filter 100 includes a filter membrane 102 and a rib structure 137. Nozzles 50 and filter 100 are spaced apart relative to each other such that a liquid chamber 53 is located between nozzles 50 and filter 100. Liquid chamber 53 is common to filter 100 and any or all of nozzles 50. Liquid manifold 47 is often referred to as a second liquid chamber with liquid chamber 53 being referred to as a first liquid chamber. In FIG. 4B, typically liquid flow directions within jetting module 48 are shown using arrows "→".

Liquid chamber 53 includes a port 150. Port 150 is located downstream relative to filter 270. Liquid manifold 47 includes port 122 which is positioned upstream from filter 100. Nozzle plate 49, filter 100, and manifold 47 are typically formed as separate components and assembled to form jetting module 48. Typically, port 150 functions as an outlet port for liquid while port 122 functions as an inlet port. In alternative embodiments of the present invention, jetting module 48 can include more ports, described in more detail below. The functions of ports 150 and 122 as well as any additional ports can also change. This is also described in more detail below.

As shown in FIG. 4B, filter membrane 102 includes pores 110 that are columnar, are uniformly round in shape, have a uniform diameter, and are sized to effectively filter particles that may obstruct, in whole or in part, or otherwise adversely affect nozzle orifice having sizes of from 1 μm to 20 μm. Pores 110 are arranged in a two dimensional pattern in which the pores 280 are positioned in an ordered manner relative to each other. Pores 110 are also grouped together with non-porous segments positioned between pore groups. Rib structures 137 are located in these non-porous segments. Alternative embodiments of filter 100 are permitted and include, for example, those alternatives discussed with reference to FIG. 4A.

Liquid chamber 53 is formed in or with one or more of the components that make up jetting module 48. This includes, for example, all or portions of one or more of substrate 85, substrate 97, and a substrate 95 positioned between filter 100 (substrate 97) and nozzle plate 49 (substrate 85).

Although shown in FIG. 4B as being made from one substrate, liquid chamber 53 and other printhead components such as nozzle plate 49, filter 100, and manifold 47 can each be formed using more than one substrate. Each substrate can include a single material layer or a plurality of material layers. One or more of each substrate can include at least one material layer formed by a deposition process or at least one material layer applied by a lamination process or combinations thereof. An additional adhesive can be used in some example embodiments to adhere one substrate to another substrate while no additional adhesive is used to adhere substrates to each other in other example embodiments. Liquid chamber 53 and other printhead components such as nozzle plate 49, filter 100, and manifold 47 can each be made from various materials including, for example, ceramic, polymer, semiconductor materials such as silicon, stainless steel, and other metal materials. When a metal material is selected for the filter 100, the metal can be of the type that is deposited by electro-deposition, for example, Ni, Pd, and combinations thereof.

In FIG. 4B, filter 100 includes a planar membrane 102 positioned to span across or "bridge" liquid chamber 53. As such, portions of liquid chamber 53 are defined by filter membrane 102, portions of substrate 85, and portions of substrate 95. Liquid chamber 53 is in fluid communication with at least one of the pores 110 and at least one of the nozzles 50. As shown, liquid in liquid chamber 53 is provided to each of nozzles 50. Liquid chamber 53 allows liquid pressure and flow characteristics to normalize across the array of nozzles 50 after the liquid passes through pores 110 located in filter membrane 102 and before the liquid is directed toward nozzles 50.

As shown in FIG. 4B, each nozzle 50 includes a liquid flow channel 50B in fluid communication with a nozzle orifice 50A, commonly referred to as a nozzle bore. Also in fluid communication with liquid chamber 53, each flow channel 50B provides a portion of the liquid in liquid chamber 53 to a corresponding orifice 50A. Each flow channel 50B is formed in substrate 85. Flow channels 50B help to condition flow turbulence in the liquid as the liquid enters nozzles 50 as described U.S. Pat. No. 7,607,766 B2, which is incorporated by reference herein. As shown, flow channels 50B are rectangular in shape. Flow channels 50B can include other shapes and provide other functions. For example, one or more of flow channels 5013 can have circular or elliptical cross sections. The walls of the flow channels 50B can be substantially perpendicular to the plane of the nozzle plate 49 or alternatively the walls can converge as they extend toward a corresponding nozzle orifice 50A in order to better direct liquid flow through nozzle 50.

Outlet port 150 is positioned in jetting module 48 at a location downstream from filter 100. Outlet port 150 provides an alternate fluid path for directing liquid away from nozzles 50 and out of jetting module 48 after the liquid passes through filter 100. Outlet port 150 can include a valve to control flow of fluid passing through this port. Liquid chamber 53 can include one or more outlet ports 150. As shown in FIG. 4B, jetting module includes outlet port 150A and outlet port 150B although other example embodiments include less or more. Outlet port 150A, located on one side of liquid chamber 53 in jetting module 48, provides a liquid flow path away from nozzles 50. Outlet port 150B is located in a side of liquid chamber 53 that is opposite outlet port 150A. Outlet port 150B is typically used to achieve better flow profile characteristics during a jetting module cross-flushing operation. Outlet ports 150A and 150B are appropriately sized to provide a desired fluid flow through liquid chamber 53 during the cross-flush operation.

As shown in FIG. 4B, manifold 47 optionally includes an outlet port 124 in addition to inlet port 122. Outlet port 124 is positioned upstream of filter 100 and is used during a cross-flushing operation to help remove particulate matter that has accumulated in manifold 47 or on filter 100 during jetting module 48 operation. This type of cross-flushing operation includes establishing a flow across an upstream surface of filter 100 in manifold 47 from inlet port 122 to outlet port 124. As this cross-flushing process helps to remove particulate matter that has accumulated on filter 100 during jetting module 48 operation, variations in pressure drop, commonly referred to as loss, created by the accumulation of particulate matter on an upstream surface of filter 100 are reduced. Periodically removing particulate material from the upstream surface of filter 100 using a cross-flush operation can help maintain pressure drop across filter 100 at tolerable levels.

Whereas outlet port 124 is located in manifold 47 upstream relative to filter 100 to allow particles to be flushed from manifold 47, outlet port 150A or outlet port 150B is positioned in liquid chamber 53 positioned downstream relative to filter 100 to allow particles to be flushed from liquid chamber 53. The cross-flushing action provided by outlet port 150A or outlet port 150B allows for some of the liquid to flow across and away from inlets of flow channels 50B.

Advantageously, incorporation of one or both of outlet port 150A or outlet port 150B in the example embodiments of the present invention as described herein helps increase printhead reliability and print quality by cross-flushing particulate matter present in liquid located downstream of filter 100. Particulate matter may still be present in the liquid even though the liquid has already been filtered by filter 100. For example, if filter 100 and nozzle plate 49 are separately formed components which are subsequently assembled to form jetting module 48, undesired particulate matter that may partially or fully occlude each one or more of nozzles 50 can be generated during the assembly process. Also, when printhead 30 has not been used for a period of time, obstructions in one or more of nozzles 50 may develop from a congealing action associated with liquid. For example, some pigment-based inks can form relatively soil plugs in nozzles 50 when printhead 30 is not operated for some time. The use of outlet port 150A or outlet port 150B can be used to generate a cross-flushing action to assist in the removal of the aforementioned particulate matter and obstructions.

Outlet port 150A or outlet port 150B can be used to cross-flush liquid away from nozzles 50 at various times. For example, cross-flushing can be performed at the point of manufacture as part of an assembly test. Alternatively, the printing system can be configured so that cross-flushing can also be used in the field. Cross-flushing examples are discussed in more detail below. In some example embodiments, outlet port 150A or outlet port 150B is used to cross-flush printhead 30 on a predetermined schedule. In some example embodiments, outlet port 150A or outlet port 150B is used to cross-flush printhead 30 automatically while in other example embodiments, outlet port 150A or outlet port 150B is used to cross-flush printhead 30 as a result of operator intervention. In some example embodiments, outlet port 150A or outlet port 150B is used to cross-flush printhead 30 each time printhead 30 is started up. In some example embodiments, outlet port 150A or outlet port 150B is used to cross-flush printhead 30 as part of a corrective action undertaken to alleviate a print defect caused by, for example, a misaligned or missing jet of liquid. It is understood that outlet port 150A or outlet port 150B can be operated to cross-flush printhead 30 with liquids other than ink. For example, various suitable cleaning agents may be employed. In some example embodiments, liquid chamber 53 is also provided with an inlet port that is distinct from pores 110 of filter 100 that can be used to provide a liquid other than ink to liquid chamber 53.

In the example embodiments described above with reference to FIGS. 4A and 4B, fluid flow associated with any or all of ports 122, 124, 150A, or 150B can be selectively occluded by a corresponding valve 160. Each valve 160 can be operated to selectively redirect a flow of a portion of liquid either toward or away from at least one of nozzles 50. In some example embodiments, valve 160 is manually operated while in other example embodiments, valve 160 is operated under the influence of micro-controller 38 (shown in FIG. 1). Valve 160 can be operated from a fully closed position in which no fluid flow occurs to a partially open or fully open position in which varying degrees of fluid flow occur. Valves 160 can be any suitable valve that accommodates contemplated liquid operating pressures and flow rates. The selection of a valve 160 can be motivated by its particular compatibility with various material characteristics of liquid or by the design characteristics of valve 160 that reduce the likelihood of particle generation during printhead operation. Valves 160 can be external to jetting module 48. Alternatively, valve 160 can be a MEMS valve which can be advantageous when other components of printhead 30 are fabricated using MEMS processes.

Optionally, the cross-flushing operation to remove particulates from chamber 47 and the upstream surface of filter membrane 100 can be enhanced by ultrasonically vibrating jetting module 48 or the liquid in jetting module 48. Such vibrations can dislodge the particulate material from the surfaces of the chamber and the upstream surface of the filter membrane 100 so that they can be swept out of the jetting module. Piezoelectric elements or actuators bonded to the exterior of the jetting module may be employed to generator the desired ultrasonic vibrations. Optionally the piezoelectric actuators are driven at a plurality of frequencies to further enhance the effectiveness of the cross-flush as described in, for example, European Patent EP 1 095 776.

In the example embodiment shown in FIG. 4B, the components of jetting module 48 can be separate parts that are assembled to form jetting module 48. One or more of these components can also be formed and assembled using MEMS fabrication techniques as described below.

Jetting module 48 includes a plurality of stacked planar substrates with nozzles 50, liquid chamber 53 and filter 100 being formed in one or more of these planar substrates. This configuration lends itself to MEMS fabrication. Accordingly, in this example embodiment of the present invention, one or more of the features of jetting module 48, for example, nozzles 50, liquid chamber 53, or filter 100, are formed using MEMS fabrication techniques.

MEMS fabrication techniques are preferentially employed to form various components having various combinations of conductive, semi-conductive, and insulator material layers, some or all of these layers having features formed therein by various material deposition and etching processes commonly controlled by a patterned mask layer. As previously described, nozzles 50 can be formed in substrate 85 using MEMS processes. MEMS processes can also be used to form filter 100 from substrate 97. In this example embodiment substrate 97 includes a semi-conductor material. Semi-conductor materials such as silicon are readily processed using MEMS fabrication techniques.

Substrate 97 is patterned and etched to remove various portions of the semi-conductor material, for example, silicon, to form rib structures 137 and filter membrane 102. Pores 110 are formed in filter membrane 102 of substrate 97. As shown in FIG. 4B, pores 110 are arranged in pore groups 120 although other configurations are permitted. Pores 110 are formed using additional patterning and etching processes. Adjacent rib structures 137 are spaced apart from each other by one of the pore groups 120 formed in filter membrane 102. A typical rib structure 137 has a thickness of at least 10 μm to about 450 μm thick. A typical filter membrane 102 has a thickness of about 2 μm to about 10 μm. As shown in FIG. 4B, rib structures 137 bracket a pore group 120 on two sides. In other example embodiments, one or more pore groups 120 can be surrounded by one or more rib structures 137. For example, rib structures 137 can be arranged in a two-dimensionally grid relative to filter membrane 102.

Rib structures 137 are integrally formed with filter membrane 102. Rib structures 137 help to reinforce filter membrane 102 which allows filter membrane 102 to be thinner than would be otherwise possible. It is desired that a pressure drop, commonly referred to as loss, associated with the liquid as it flows through pore groups 120 be reduced as much as possible. Thinner filter membranes 102 reduce the loss across filter 100 when compared to thicker filter membranes 102. As such, operating pressures can be lowered when a thinner filter membrane 102 is used. Typically, it is desirable to keep operating pressures as low as possible in order to maintain reliable system operation. Increased operating pressures put unwanted stress on the system. Additionally, when operating pressures are increased, equipment costs can also increase. For example, pumps have to be sized appropriately, which adds cost to the system.

In some example embodiments, a loss across filter 100 of no more than 10 psi is desired. In other example embodiments, a loss across filter 100 of no more than 5 psi is desired. In other example embodiments, a loss across filter 100 of no more than 3 psi is desired. A loss across filter 100 can vary as a function of liquid flow rate with higher flow rates experiencing higher pressure drops. The pressure drop across filter 100 can also be dependant on factors such as the size of pores 110, the number of pores 110 and the thickness of filter membrane 102. Pores 110 are typically sized to trap a predicted or measured size of particulate mater within the liquid. Generally stated, the effective diameter of the pore should be less than ½, and preferably less than ⅓ of the effective diameter of the orifice 50A of the nozzle 50. The effective diameter of an opening, such as a nozzle or pore, is equal to two times the square root of the opening area divided by π. For example, each nozzle 50 of printhead 30 has an effective diameter when viewed in a direction of fluid flow through the nozzle 50 and each pore 110 has an effective diameter when viewed along the direction of fluid flow through the pores 110. The effective diameter of the pore 110 is less than half the area of the nozzle 50.

In some example embodiments, the number of pores 110 is increased to help reduce an expected pressure drop as liquid flows through filter 100. In other example embodiments, the thickness of filter membrane 102 is controlled reduce an expected pressure drop across filter 100. Accordingly, very thin filter membranes 102 may be required. In some instances, filter membranes 102 including very thin thicknesses may be prone to handling damage when filter 100 is assembled into printhead 30. Filter membranes 102 including these thicknesses may not be well suited for withstanding the effects of the pressure differential created by liquid 52 across filter membranes 102. Rib structures 137 formed in accordance with the present invention advantageously reinforce filter membranes 102 thereby reducing the potential for damage to their delicate structures. Unlike conventional printhead filter systems including relatively thick membranes with corresponding large pressure drops, the formation of rib structures 137 advantageously allows for the formation reinforced filter membranes 102 that are capable of resisting damage while not adversely increasing the pressure drop across filter membrane 100. Typically, the thickness of filter membranes 102 is <10 μm, preferably <5 μm, and more preferable <2 μm.

Figure 5:
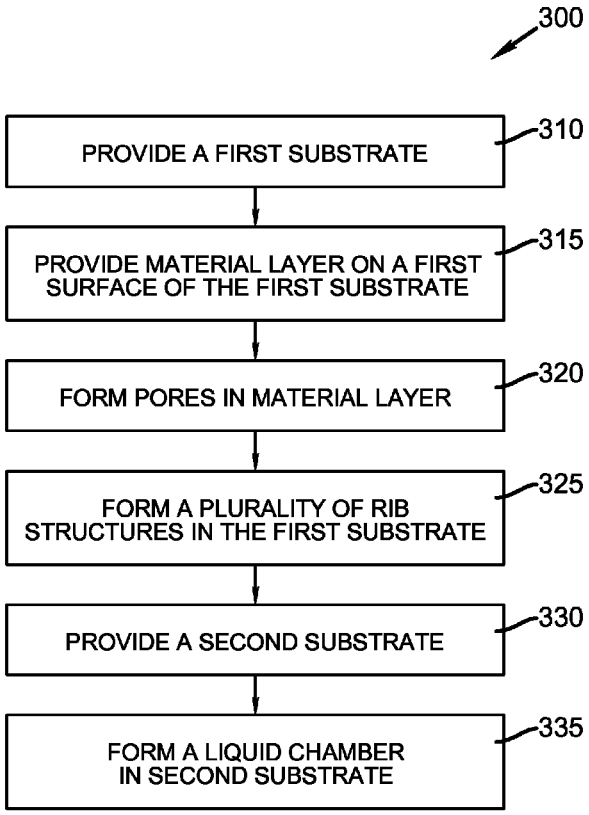
FIG. 5 is flow chart describing a method of manufacturing a filter suitable for use in a jetting module including an example embodiment of the invention.
Figure 6A:
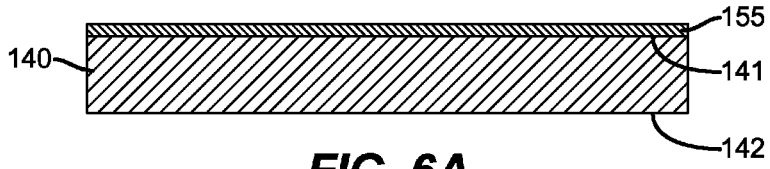
FIGS. 6A through 6G show stages of formation of a filter manufactured using the method described in FIG. 5.

Referring to FIGS. 5 and 6A-6G, a flow chart representing a method 300 for manufacturing a portion of filter membrane 100 in accordance with an example embodiment of the invention is shown. Various processes steps associated with the method represented by the flow chart in FIG. 5 are also illustrated in FIGS. 6A, 6B, 6C, 6D, 6E, 6F, and 6G. In step 310, a first substrate 140 is provided, the first substrate 140 having a first surface 141 and a second surface 142. In this example embodiment, first substrate 140 includes a semiconductor material, for example, silicon. In step 315, a material layer 155 is provided over first surface 141 as illustrated in FIG. 6A. In this example embodiment, material layer 155 is a silicon dioxide layer formed by coating first surface 141 with silicon dioxide. Other materials can be used, for example, tetraethyl orthosilicate (TEOS), silicon nitride, silicon oxynitride, and silicon carbide. In some example embodiments, one or more additional layers, for example, a silicon nitride (SiN), silicon oxynitride, or silicon carbide layer is also provided.

Figure 6B:
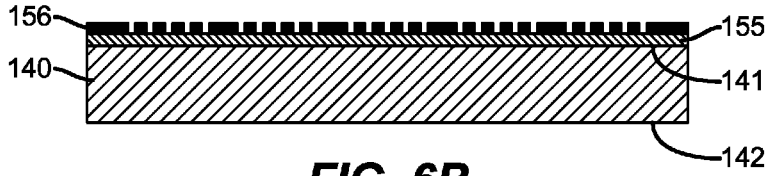
Figure 6C:
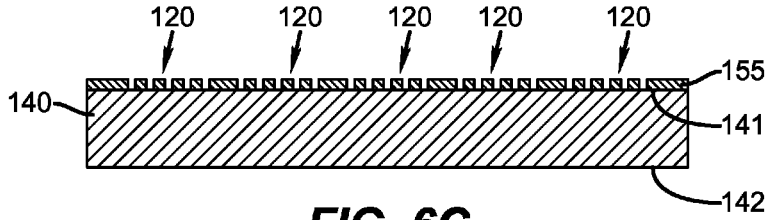

In step 320, a plurality of pore groups 120 are formed in material layer 155. In this example embodiment, a first mask layer 156, for example, a photo-resist is deposited and patterned on a surface of material layer 155 as shown in FIG. 6B. An etchant is then used to etch the material layer 155 exposed through the patterned first mask layer 156 to form the plurality of pore groups 120 as shown in FIG. 6C. First mask layer 156 can be removed at this point or at a latter point in time if so desired. In this example embodiment, material layer 155 includes a thickness selected to reduce expected pressure drops when a desired liquid is subsequently made to flow through a printhead 30 that incorporates the formed filter membrane 102.

Figure 6D:
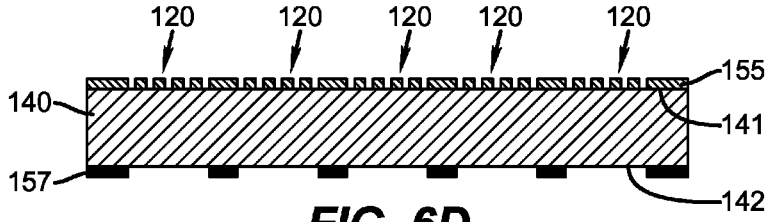
Figure 6E:
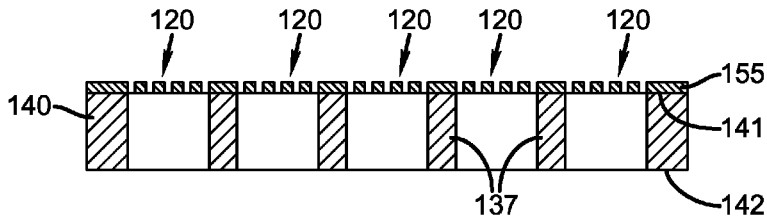

In step 325, a plurality of rib structures 137 is formed in first substrate 140. In this example embodiment, a second mask layer 157, for example, a photo-resist is deposited and patterned on second surface 142 of first substrate 140 as shown in FIG. 6D. An etchant is then used to etch portions of first substrate 140 that are exposed through the patterned second mask layer 157 to form a plurality of rib structures 137 in first substrate 140 as shown in FIG. 6E. The rib structures 137 are positioned such that a rib structure 137 is located between consecutive pore groups 120. In this example embodiment of the invention, rib structures 137 are formed to reinforce portions of material layer 155 proximate to a pore group 120. Second mask layer 157 is shown removed in FIG. 6E. In one example embodiment, an aspect ratio of the pore groups 120 is 4 to 1 while the size of rib structures 137 is approximately 20 μm but these values can vary depending on material type and thickness. Preferably, the spacing between ribs 137 for the pore groups 120 is no greater than 200 times the thickness of the filter membrane 102, and more preferably no greater than 75 times the filter membrane 102 thickness to reduce the potential for damage to filter membrane 102 structures.

Figure 6F:
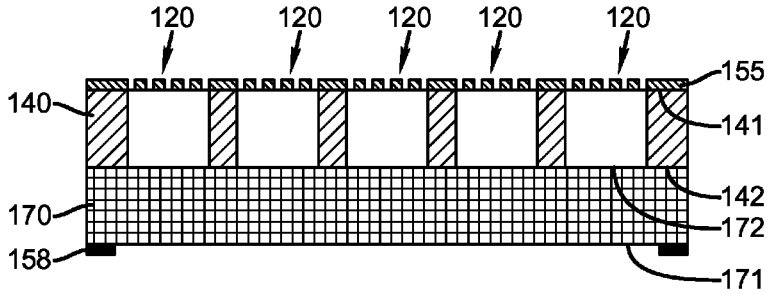
Figure 6G:
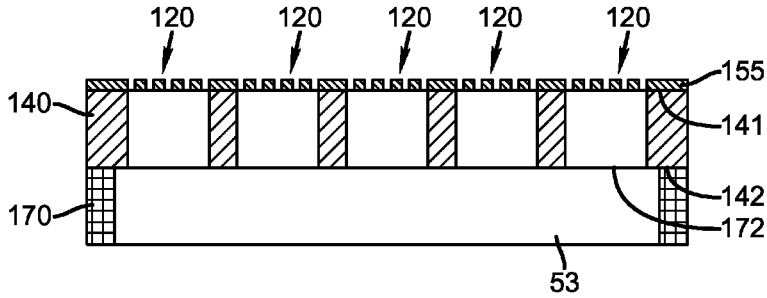

In step 330, a second substrate 170 is provided, the second substrate 170 including a first surface 171 and a second surface 172. In step 330 a liquid chamber 53 is formed in second substrate 170. In this example embodiment, a third mask layer 158, for example, a photo-resist is deposited and patterned on first surface 171 of second substrate 170 as shown in FIG. 6F. In step 335, a liquid chamber 53 is formed in second substrate 170 by using an etchant to etch portions of second substrate 170 that are exposed through the patterned third mask layer 158 as shown in FIG. 6G. Liquid chamber 53 is positioned to allow for fluid communication with at least one of the pore groups 120. The third mask layer 158 is shown removed in FIG. 6G. Liquid chamber 53 is combined with one filter 100 and one or more additional substrates, for example, nozzle plate 49, to form printhead 30.

In some embodiments in which liquid chamber 53 includes an outlet port 150, the port geometry can be created using this same process by inclusion of the desired port features in one or more of the masks used to define the etched regions of substrate 170, substrate 140, and material layer 155. The port can be formed through the side of substrate 170, or alternatively, the port can pass through substrate 140 and material layer 155. The portions of the flow channel(s) formed in layer 95 and layer 97, shown in FIG. 4B, (which along with the portion of the flow channel formed in substrate 87 form port 150) can be formed in this manner.

In some example embodiments, the second surface 142 of first substrate 140 is adhered to one of the first surface 171 and the second surface 172 of the second substrate 170 with an additional adhesive. In some example embodiments, an additional adhesive is not used to adhere first substrate 140 to second substrate 170. In some example embodiments, first substrate 140 and second substrate 170 are integrated into a third substrate, referred to as an integrated substrate, that includes an etch stop layer positioned between the first substrate 140 and second substrate 170. One example of such an integrated substrate is a silicon-on-insulator substrate (SOI). Alternatively, a timed etch without an etch stop layer can also form a suitable structure.

Manufacturing method 300 can be modified in various manners to process integrated substrates such SOI substrates. For example, liquid chamber 53 can formed by etching second substrate 170 exposed by the patterned third mask layer 158 through to the etch stop layer. Rib structures 137 can be formed in first substrate 140 by a process that includes etching regions of the etch stop layer that are exposed after the removal of various regions of second substrate 170. The steps illustrated in manufacturing method 300 are provided by way of example only. Additional or alternate steps or sequences of steps are within the scope of the present invention.

Figure 7:
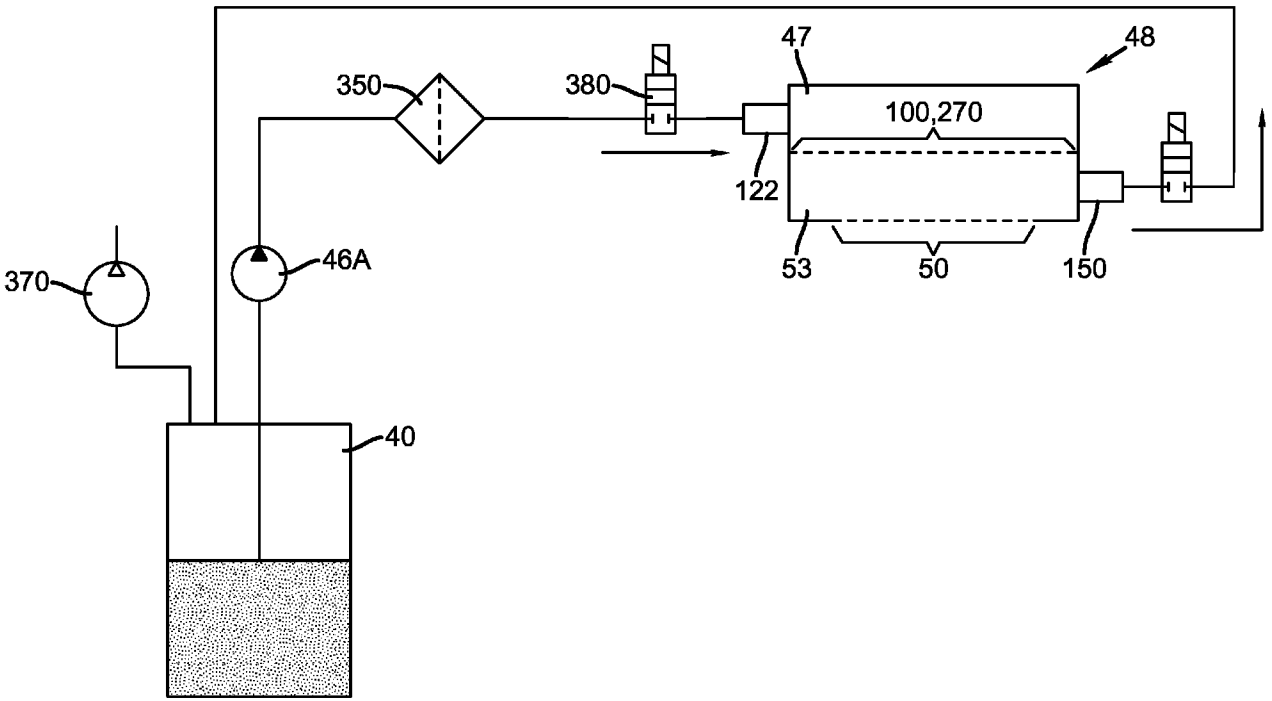
FIGS. 7 through 9 are schematic diagrams of example embodiments of printing system fluid systems made in accordance with the present invention.
Figure 8:
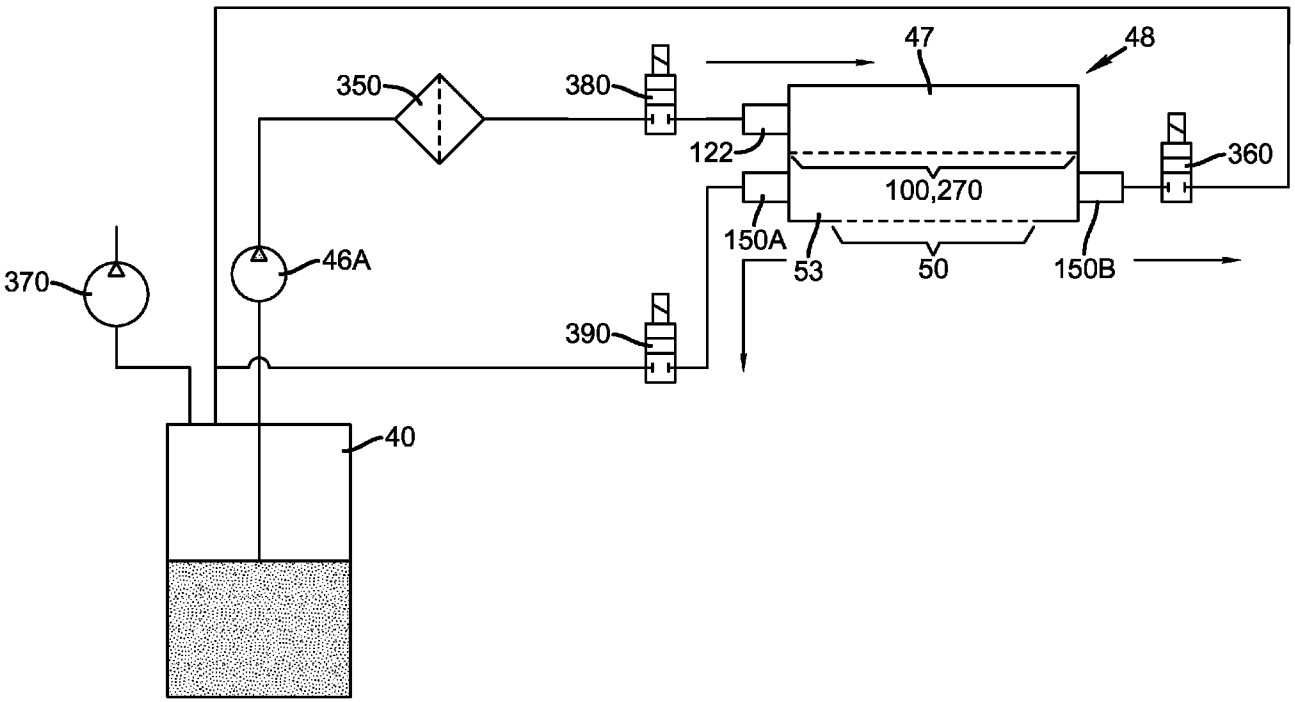
Figure 9:
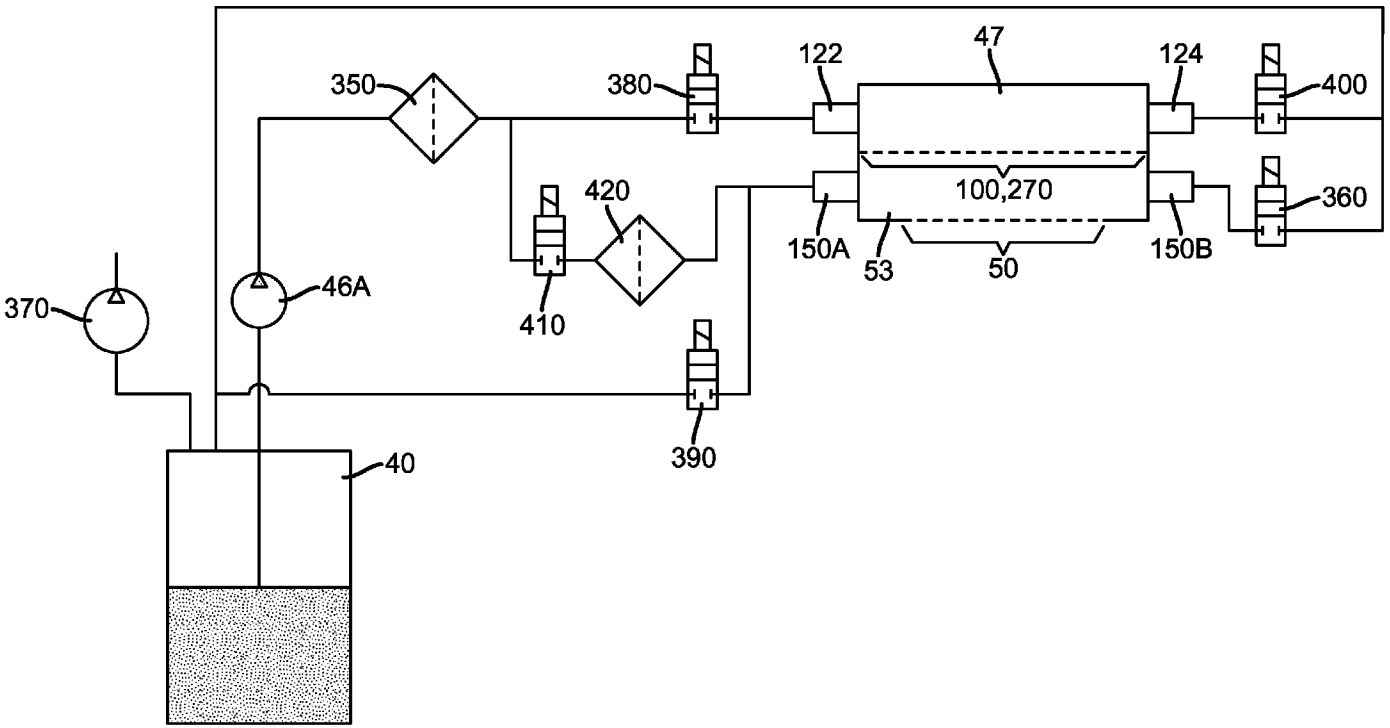

Referring to FIGS. 7 through 9, example embodiments of fluid systems are shown that are suitable for use with printheads 30 or jetting modules 48 including the present invention. These fluid systems can be used to accomplish the cross flushing of jetting module 48 describe above. Broadly described, cross flushing includes moving the fluid through the chambers to remove trapped particles or accumulated debris from the jetting module through one of ports. Referring to FIG. 7, fluid from fluid reservoir 40 is pumped by pump 46A through filter 350 and into inlet port 122 of jetting module 48 when valve 380 is open. It flows from the inlet port into fluid chamber or manifold 47 that is located upstream of filter 100; 270. The fluid passes through filter 100; 270 that is either integrated with or integral to jetting module 48 and enters fluid chamber 53. When valve 360 is closed, the fluid pressure rises to cause the fluid to be jetted from the plurality of nozzles 50 that are in fluid communication with fluid chamber 53. When valve 360 is open, the fluid is drawn out of the fluid chamber 53 through port 150B and is returned to fluid reservoir 40. A vacuum, applied to fluid reservoir 40 by vacuum pump 370 assists the flow of fluid from port 150B back to fluid reservoir 40. The flow of fluid from port 122 through fluid chamber 53 and out through port 150B enables the removal of particles from fluid chamber 53.

FIG. 8 illustrates another embodiment of a fluid system. Like the fluid system described with reference to FIG. 7, fluid is supplied to fluid chamber or manifold 47 of the jetting module 48 through inlet port 122 located upstream of filter 100; 270. Fluid chamber 53, located downstream from filter 100; 270, includes a first port 150A and a second port 150B. Valves 360 and 390 associated with ports 150A and 150B are used to control the fluid flow through ports 150A and 150B. If both valves 360 and 390 are closed, the fluid pressure rises to cause the fluid to be jetted from the plurality of nozzles 50 that are in fluid communication with fluid chamber 53. If one or both of valves 360, 390 are open, fluid will flow through the corresponding port 150B, 150A and be returned to fluid reservoir 40. This allows particles to be removed from fluid chamber 53 through either or both of ports 150A, 150B. In one embodiment, valves 360 and 390, associated with both first ports 150A and second port 150B are open concurrently to enable fluid to flush out from fluid chamber 53 quickly. In another embodiment, one valve 360 or 390 is open at a time, to sequentially allow liquid to flush from first one end of fluid chamber 53 and then the other end of fluid chamber 53. This enables higher flow rates to be achieved through port 150A or 150B that is open thereby providing more effective flushing of the corresponding end portion of fluid chamber 53.

Referring to FIG. 9, in another embodiment of the fluid system, jetting module 48 includes four ports, two ports 122 and 124 upstream of filter 100; 270 and two ports 150A and 150B located downstream of filter 100; 270. The fluid system shown in FIG. 9 provides a greater number of options for flushing fluid chambers 53 and 47 of jetting module 48. For example, if valves 380 and 400 are open, while valves 360, 390, and 410 are closed, fluid can flush particles out of the fluid chamber provided by manifold 47. This can serve to flush particles off the upstream face of filter 100; 270 which helps to keep the pressure drop across filter 100; 270 at acceptable levels. Opening valves 410 and 360, while valves 390, 400, and 380 are closed causes liquid to cross flush fluid chamber 53 to aid in removal of particles in that chamber. A filter 420 is located in the line supplying fluid directly to liquid chamber 53, downstream of filter 100; 270 via port 150A to minimize the risk of carrying particles from the fluid system directly into fluid chamber 53. While FIG. 9 shows an embodiment in which fluid supplied for cross-flushing fluid chamber 53 is the same fluid that is supplied to manifold 47, it is contemplated that a second fluid can be supplied from a second fluid reservoir for the cross-flushing of fluid chamber 53.

Alternatively, valves 380, 400, 390, and 360 can be opened, with valve 410 closed to concurrently cross-flush both the first and second fluid chambers. Filter 100; 270 can be back-flushed by supplying fluid to fluid chamber 53 through valve 410 and port 150A while withdrawing the fluid from manifold 47 through port 124 and valve 400. Valves 380, 390, and 360 are closed during this cross-flushing operation. Prior to introducing fluid into the second fluid chamber via port 150A for any of the flushing processes described above, it can be desirable to first flush the fluid through filter 420 and the corresponding fluid line with valves 380, 390, and 410 open and valves 360 and 400 closed for a period of time. This operation helps reduce the risk that particles will be injected into the second fluid chamber through port 150A.

Optionally, the various flushing operation to remove particulates from the surface or surfaces of manifold 47, chamber 53, filter 100; 270 and nozzle plate 49 can be enhanced by ultrasonically vibrating at least one of or a portion of the filter 100; 270, nozzle plate 49, and the interior surfaces of the first liquid chamber 53 and the manifold (second liquid chamber) 47. Such vibration can dislodge the particulate material from these surfaces so that the particles can be flushed out of jetting module 48. Piezoelectric elements or actuators bonded to the exterior of jetting module 48 can be used to generate the desired ultrasonic vibrations. Optionally the piezoelectric actuators can be driven at a plurality of frequencies to further enhance the effectiveness of the cross-flush as described in EP 1 095 776. As described above, filter 100; 270 preferably includes a sheet of material having straight pores through it as opposed to pores having torturous paths to allow more effective particle removal flushing operations.

The invention has been described in detail with particular reference to certain example embodiments thereof, but it will be understood that variations and modifications can be effected within the scope of the invention.

PARTS LIST

20 continuous printing system
22 image source
24 image processing unit
26 mechanism control circuits
28 device
30 printhead
32 recording medium
34 recording medium transfer system
36 recording medium transfer control system
38 micro-controller
40 reservoir
42 catcher
44 recycling unit
46 pressure regulator
46A pump
47 manifold
48 jetting module
49 nozzle plate
50 nozzles
50A nozzle orifice
50B liquid flow channel
51 heater
52 liquid
53 liquid chamber
54 drops
56 drops
57 trajectory
58 drop stream
60 gas flow deflection mechanism
61 positive pressure gas flow structure
62 gas
63 negative pressure gas flow structure
64 deflection zone
66 small drop trajectory
68 large drop trajectory
72 first gas flow duct
74 lower wall
76 upper wall
78 second gas flow duct
82 upper wall
85 substrate
86 liquid return duct
87 substrate
88 plate
90 front face

92 positive pressure source
94 negative pressure source
95 substrate
96 wall
97 substrate
100 filter
102 filter membrane
110 pores
120 pore groups
122 port
124 port
137 rib structure
140 first substrate
141 first surface
142 second surface
150 port
150A port
150B port
155 material layer
156 first mask layer
157 second mask layer
158 third mask layer
160 valve
170 second substrate
171 first surface
172 second surface
249 first substrate
250 nozzle
252 liquid chamber
253 liquid jets
260 source of liquid
270 filter
280 pores
300 method
310 step
315 step
320 step
325 step
330 step
335 step
350 filter
360 valve
370 vacuum pump
380 valve
390 valve
400 valve
410 valve
420 filter

The invention claimed is:

1. A continuous liquid ejection printhead comprising:

a liquid source;

a first substrate, portions of the first substrate defining a plurality of nozzles that emit liquid jets from liquid provided under pressure from the liquid source;

a filter; and a second substrate, portions of the second substrate defining a liquid chamber including a port, the liquid chamber being common to and in fluid communication with the plurality of nozzles and the filter, the first substrate and the filter being spaced apart from each other by the second substrate such that the liquid chamber is positioned between the first substrate and the filter, the filter spanning across the liquid chamber to define, along with the first substrate, portions of the liquid chamber, wherein the port is an outlet port through which liquid can flow out of the liquid chamber without passing through the plurality of nozzles.

2. The printhead of claim 1, the liquid chamber being a first liquid chamber, the printhead further comprising:

a second liquid chamber positioned upstream of the filter relative to a direction of fluid flow through the filter, the second liquid chamber including a port through which the second liquid chamber is in fluid communication with the liquid source.

3. The printhead of claim 2, the port associated with the second liquid chamber being a first port, the second liquid chamber including a second port.

4. The printhead of claim 2, further comprising:

an actuator that ultrasonically vibrates at least a portion of one of the filter, the nozzle plate, and interior surfaces of the first liquid chamber and the second liquid chamber.

5. The printhead of claim 1, the outlet port associated with the liquid chamber being a first port, the liquid chamber including a second port.

6. The printhead of claim 5, the second port being positioned opposite the first port.

7. The printhead of claim 1, further comprising:

a valve adapted to control a flow of the liquid through the outlet port, the valve being located external relative to the outlet port.

8. The printhead of claim 1, further comprising:

a valve adapted to control a flow of liquid through the outlet port, the valve being located within the outlet port.

9. The printhead of claim 1, wherein the filter includes a plurality of through holes having a uniform size.

10. The printhead of claim 1, wherein the filter includes one of a plurality of columnar through holes and a plurality of tapered through holes.

11. The printhead of claim 1, wherein the filter includes an electroformed metal material.

12. The printhead of claim 1, wherein the filter includes a filter membrane and a reinforcement structure.

13. The printhead of claim 12, wherein the filter includes a planar member.

14. The printhead of claim 1, wherein the filter is made from a stainless steel material, a ceramic material, a polymer material, a metal material, a semi-conductor material, and combinations thereof.

15. The printhead of claim 1, wherein the liquid chamber is made from one of a stainless steel material, a ceramic material, a polymer material, and combinations thereof.

16. The printhead of claim 1, wherein the second substrate is planer.

* * * * *